US011724864B2

(12) United States Patent
Corradi et al.

(10) Patent No.: US 11,724,864 B2
(45) Date of Patent: Aug. 15, 2023

(54) OPENING DEVICE FOR A PACKAGING FOR POURABLE PRODUCTS

(71) Applicant: TETRA LAVAL HOLDINGS & FINANCE S.A., Pully (CH)

(72) Inventors: Davide Corradi, Modena (IT); Rocco De Paola, Modena (IT); Franco Cani, Modena (IT); Massimo Tedeschi, Sant'llario d'Enza (IT); Francesca Tavoni, Modena (IT); Giulio Bertani, Carpi (IT); Pietro Martini, Parma (IT); Livio Veronesi, San Felice sul Panaro (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 114 days.

(21) Appl. No.: 17/439,848

(22) PCT Filed: Mar. 19, 2020

(86) PCT No.: PCT/EP2020/057570
§ 371 (c)(1),
(2) Date: Sep. 16, 2021

(87) PCT Pub. No.: WO2020/193350
PCT Pub. Date: Oct. 1, 2020

(65) Prior Publication Data

US 2022/0185552 A1 Jun. 16, 2022

(30) Foreign Application Priority Data

Mar. 26, 2019 (EP) ..... 19165242

(51) Int. Cl.
*B65D 51/22* (2006.01)
*B65D 5/74* (2006.01)
(Continued)

(52) U.S. Cl.
CPC ..... *B65D 51/222* (2013.01); *B65D 5/749* (2013.01); *B65D 41/485* (2013.01);
(Continued)

(58) Field of Classification Search
CPC .... B65D 51/222; B65D 51/221; B65D 51/22; B65D 51/20; B65D 41/485; B65D 41/48;
(Continued)

(56) References Cited

U.S. PATENT DOCUMENTS 4,394,918 A * 7/1983 Grussen ..... B65D 41/3428 215/253
4,487,324 A * 12/1984 Ostrowsky ..... B65D 47/0814 215/253
(Continued)

FOREIGN PATENT DOCUMENTS

CN 107000899 A 8/2017
CN 107000900 A 8/2017
(Continued)

OTHER PUBLICATIONS

Office Action (First Office Action) dated Apr. 22, 2022, by the State Intellectual Property Office of People's Republic ol China in corresponding Chinese Patent Application No. 202010218085.6, and an English translation of the Office Action. (11 pages).
(Continued)

*Primary Examiner* — Robert J Hicks
(74) *Attorney, Agent, or Firm* — Buchanan Ingersoll & Rooney PC

(57) ABSTRACT

An opening device configured to be applied to packaging for pourable products comprises: a pouring spout defining a pouring opening through which to pour, in use, the pourable product; a cap configured to engage and disengage the pouring spout to respectively close and open the pouring opening; a closing element closing and/or sealing the pour-
(Continued)

ing opening, formed in one piece with the pouring spout and connected to the pouring spout by a breakable connecting portion configured to break during first opening of the opening device; the closing element comprising a protruding portion extending through the pouring opening and connected to the cap; and tamper-evidence device fitted to the pouring spout and initially connected to the cap by at least one breakable connecting bridge configured to break during first opening of the opening device; wherein the cap is hinged to the tamper-evidence device thereby being permanently tethered to the pouring spout.

14 Claims, 3 Drawing Sheets

(51) Int. Cl.

| | |
|---|---|
| ***B65D 41/48*** | (2006.01) |
| ***B65D 47/08*** | (2006.01) |
| ***B65D 55/08*** | (2006.01) |
| ***B65D 85/80*** | (2006.01) |

(52) U.S. Cl.
CPC ..... *B65D 47/088* (2013.01); *B65D 55/0818* (2013.01); *B65D 85/80* (2013.01); *B65D 2401/15* (2020.05); *B65D 2547/066* (2013.01)

(58) Field of Classification Search
CPC .... B65D 55/0818; B65D 55/08; B65D 55/06; B65D 47/088; B65D 47/0885; B65D 47/0876; B65D 47/0857; B65D 85/80
USPC .... 220/278, 277, 265, 266, 254.3, 837, 836, 220/810, 375; 215/254, 253, 250, 237, 215/235, 306; 53/492; 229/214, 213, 229/210, 200
See application file for complete search history.

(56) References Cited

U.S. PATENT DOCUMENTS

| | | | | |
|---|---|---|---|---|
| 5,287,983 | A | 2/1994 | Reil et al. | |
| 5,799,840 | A * | 9/1998 | Mogard | B65D 47/0842 222/541.9 |
| 6,003,712 | A * | 12/1999 | Mogard | B65D 5/746 222/541.9 |
| 8,672,167 | B2 | 3/2014 | Leuenberger et al. | |
| 2005/0205618 | A1 | 9/2005 | Mabee et al. | |
| 2015/0175318 | A1 * | 6/2015 | Pellerin | B65D 43/0274 215/250 |
| 2017/0327276 | A1 | 11/2017 | Martini et al. | |
| 2019/0344540 | A1 | 11/2019 | Cavanna et al. | |

FOREIGN PATENT DOCUMENTS

| | | | |
|---|---|---|---|
| CN | 108473229 | A | 8/2018 |
| CN | 213009595 | U | 4/2021 |
| DE | 102007057863 | A1 | 6/2009 |
| DE | 102015116784 | A1 | 4/2017 |
| EP | 0 503 224 | B1 | 7/1996 |
| EP | 3025981 | A1 | 6/2016 |
| WO | 2020/193350 | A1 | 10/2020 |

OTHER PUBLICATIONS

International Search Report (PCT/ISA/210) and Written Opinion (PCT/ISA/237) dated Jul. 21, 2020, by the European Patent Office as the International Searching Authority for International Application No. PCT/EP2020/057570. (9 pages).

* cited by examiner

OPENING DEVICE FOR A PACKAGING FOR POURABLE PRODUCTS

TECHNICAL FIELD

The present invention relates to an opening device, in particular to a reclosable opening device, configured to be applied to a packaging for pourable products, in particular to a sheet packaging material for forming a package containing a pourable product, preferably a pourable food product.

More specifically, this invention relates to an opening device designed to be directly molded onto the sheet packaging material, in turn adapted to be folded, filled with the pourable product and sealed to form the package.

BACKGROUND ART

As it is generally known, many pourable food products, such as fruit juice, UHT (ultra-high temperature-treated) milk, wine, tomato sauce, etc., are sold in packages made of sterilized packaging material.

A typical example is the parallelepiped-shaped package for pourable food products known as Tetra Brik Aseptic (registered trademark), which is made by folding and sealing a laminated sheet of packaging material.

In particular, the packaging material has a multilayer structure substantially comprising a base layer for stiffness and strength, which may be made of fibrous material, e.g. paper or mineral-filled polypropylene material, and a number of lamination layers made of heat-seal plastic material, e.g. polyethylene films, covering both sides of the base layer.

In the case of aseptic packages for long-storage products, such as UHT milk or fruit juice, the packaging material also comprises a layer of gas-barrier material, e.g. aluminum foil or ethyl vinyl alcohol (EVOH) film, which is superimposed on a layer of heat-seal plastic material, and is in turn covered with another layer of heat-seal plastic material. This latter layer of plastic material forms the inner face of the package eventually contacting the pourable food product.

Packages of this sort are normally produced on fully automatic packaging machines, in which a continuous tube is formed from the sheet of packaging material.

Furthermore, the sheet of packaging material is sterilized in the packaging machine by applying a chemical sterilization agent, which is then removed after sterilization is completed.

Subsequently, the sheet of packaging material is maintained in a closed, sterile environment and is folded and sealed longitudinally to form the tube.

In order to complete the forming operations, the tube is filled from above, by means of a pipe, with the pourable food product and is formed, sealed and subsequently cut along equally spaced transversal cross sections.

Pillow packs are obtained thereby, which have a longitudinal sealing band, a top transversal sealing band and a bottom transversal sealing band, and which are then folded mechanically to form respective finished substantially parallelepiped-shaped packages.

Alternatively, the packaging material may be cut into blanks, which are formed into packages on forming spindles, and the resulting packages are filled with the food product and sealed. One example of such package is the so-called "gable top" package commonly known by the trade name Tetra Rex (registered trademark).

To open the packages described above, various solutions have been proposed, one of which involves the use of reclosable opening devices made of plastic material and substantially comprising a pouring spout, defining a through pouring opening and fitted over a hole or a pierceable or tear-off portion arranged onto a wall, typically a top wall, of the package.

According to a known solution, the pouring spout is fitted over a so-called prelaminated hole, i.e. a hole formed through the base layer only and covered, by means of a lamination process, by the other lamination layers of the packaging material, including the layer of gas-barrier material.

In other words, the pouring spout is fitted, typically glued, onto the pierceable portion of the prelaminated hole, which is made of such lamination layers.

According to an alternative solution, the pierceable portion may be defined by a patch attached to the packaging material to close a hole formed, in this case, through the full thickness of the packaging material.

According to a known solution, the opening of the pouring spout is sealed by a plastic closing element connected integrally to the pouring spout and detachable from it along a smaller-section annular tearable membrane.

In particular, the pouring spout and the closing element are injection-molded in one piece directly on the pierceable portion formed in the packaging material.

The closing element extends substantially at the same level as the packaging material, so as to seal the hole obtained at the top wall of the package.

The closing element is configured to be removed during first opening of the opening device.

The opening devices of the above-mentioned type further comprise a removable cap (or lid), e.g. screwed, which is configured to be fitted to the pouring spout to outwardly closing the latter and allowing closure of the package after the first opening thereof, i.e. after removal of the closing element.

During the production of the opening device, the pierceable portion on which the pouring spout and the closing element are to be formed is placed between two molds in an open configuration. The molds are then displaced towards the packaging material to reach a closed configuration, in which they cooperate with opposite faces of the packaging material and define a closed mold cavity housing the above-mentioned pierceable portion.

The injection molding operation is performed by injecting the molten plastic material into the mold cavity defined by the molds in the closed configuration. More specifically, the molten plastic material is forced to fill completely the mold cavity so as to form the pouring spout and the closing element.

In particular, the molten plastic material is injected onto the side of the pierceable portion which will face the inside of the finished package, thereby forming the closing element attached onto that side. Due to the molding pressure and to the particular geometry of the molds, the molten plastic material is then forced to pierce the pierceable portion and protrude from the other side thereof.

In this way, the pouring spout is formed integrally with the closing element and protruding from the other side of the pierceable portion. Hence, the pouring opening is closed, at one side thereof near the pierceable portion, by the closing element.

Subsequently, the cap, formed separately, is fitted to the pouring spout to close the pouring opening at another side thereof different from (opposite to) the one closed by the closing element.

Typically, the cap is screwed to the pouring spout. To this end, the pouring spout comprises an externally threaded and substantially cylindrical-shaped collar, whereas the cap comprises an internal thread and is initially screwed to the collar. Furthermore, the cap is normally formed integrally with a relative tamper-evidence ring, which is coaxially connected to the cap itself by means of a plurality of breakable bridges and which is destined to remain fitted to the collar once the bridges are broken and the cap is unscrewed off the collar.

It is known in the field that, after unsealing the cap, i.e. after detaching the cap from the tamper-evidence ring and unscrewing the cap off the collar by applying torque, the user must also remove (i.e. cut or tear) the pierceable portion covering the prelaminated hole, in order to access the inside of the package.

For this purpose, according to a known configuration, the opening device comprises a pull-off tongue coupled to the closing element and configured to be torn by the user, once the cap has been unscrewed from the collar.

According to an alternative solution, the closing element is formed in one piece with a protruding portion extending through the pouring opening and welded to the cap. Hence, such protruding portion integrally connects the closing element to the cap.

This configuration permits a one-step, low-effort opening of the package by simply raising the cap, i.e. while unscrewing it for the first time. In fact, during this movement, a pulling action is exerted on the closing element, integrally connected to the cap, which is torn from the pouring spout along the smaller-section annular membrane. In particular, the tearing action starts at a given point of the annular membrane and then propagates to the rest of the membrane until it causes a complete detachment of the closing element from the pouring spout.

It is known in the field the constantly growing need for reducing the environmental impact that comes along with packaging and bottling of foodstuff and non-foodstuff products. In particular, due care must be taken with regard to the plastic components of the packages, which can pollute aquatic and terrestrial environments.

DISCLOSURE OF INVENTION

It is therefore an object of the present invention to provide an opening device configured to be applied to a packaging for pourable products, which is designed to meet the above-mentioned need in a straightforward and low-cost manner.

This object is achieved by an opening device as claimed in claim 1.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
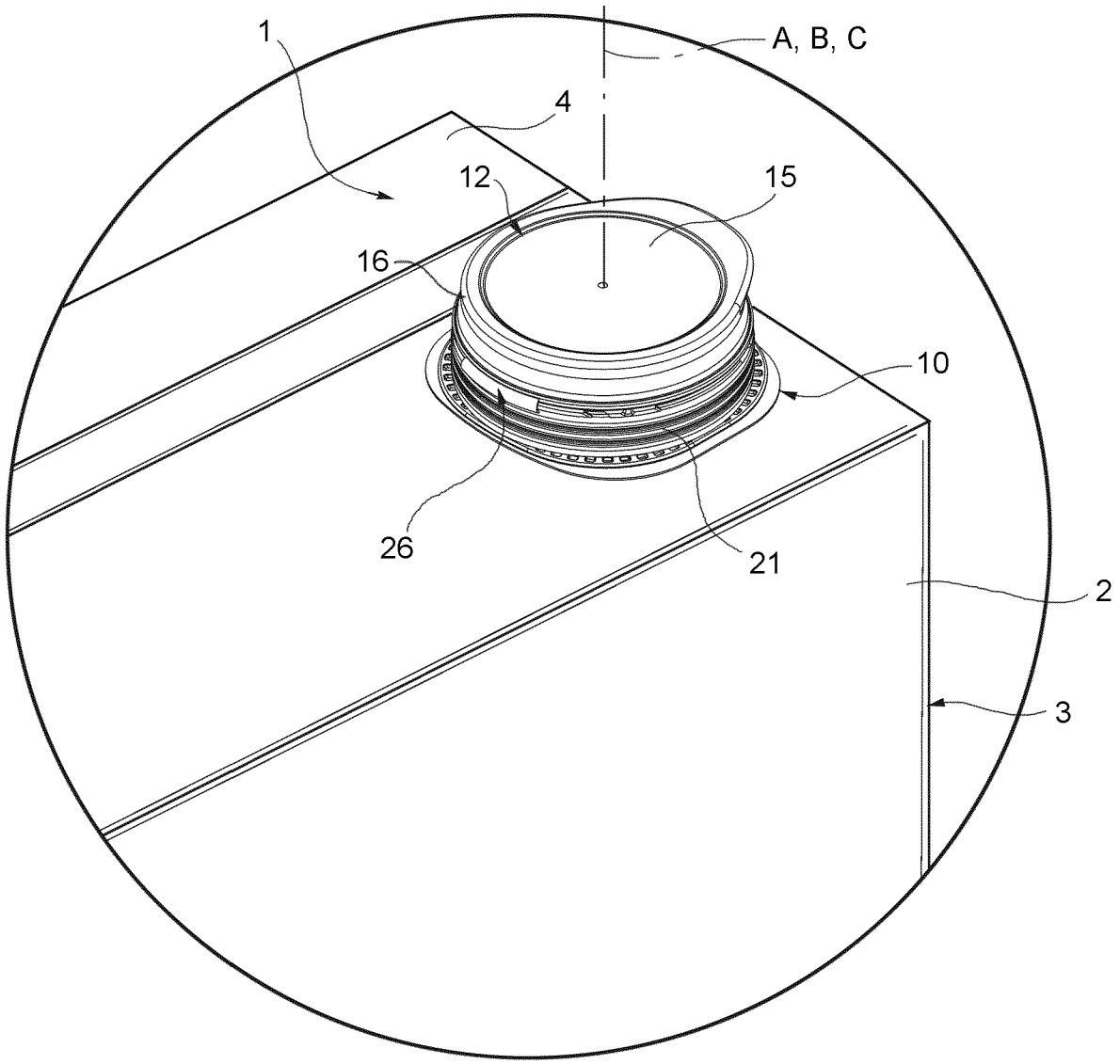
FIG. 1 is a perspective view of a top portion of a sealed package for containing pourable products, onto which an opening device according to the present invention is fitted.

With reference to FIG. 1, number 1 indicates as a whole an opening device configured to be applied to a packaging for pourable products, preferably pourable food products.

In the example shown, the packaging is defined by a package 3 made of a multilayer sheet of packaging material 2, adapted to contain the pourable product, and having a wall, in particular a top wall 4, onto which opening device 1, preferably made of plastic material, is fitted.

In particular, package 3 is adapted to contain a pourable food product, such as milk, water, fruit juice or the like.

In the example shown, opening device 1 is fitted to an opening area of packaging material 2, in turn folded, filled with the pourable product and sealed in a known manner to form package 3. The opening area is arranged in a region of packaging material 2 which will form top wall 4 of package 3.

According to an alternative embodiment not shown, opening device 1 is fitted to the opening area after package 3 has been completely formed, in this case by conventional fixing means, such as adhesive substances, e.g. glue, or by means of welding technics, e.g. laser welding or microflame welding.

Figure 2:
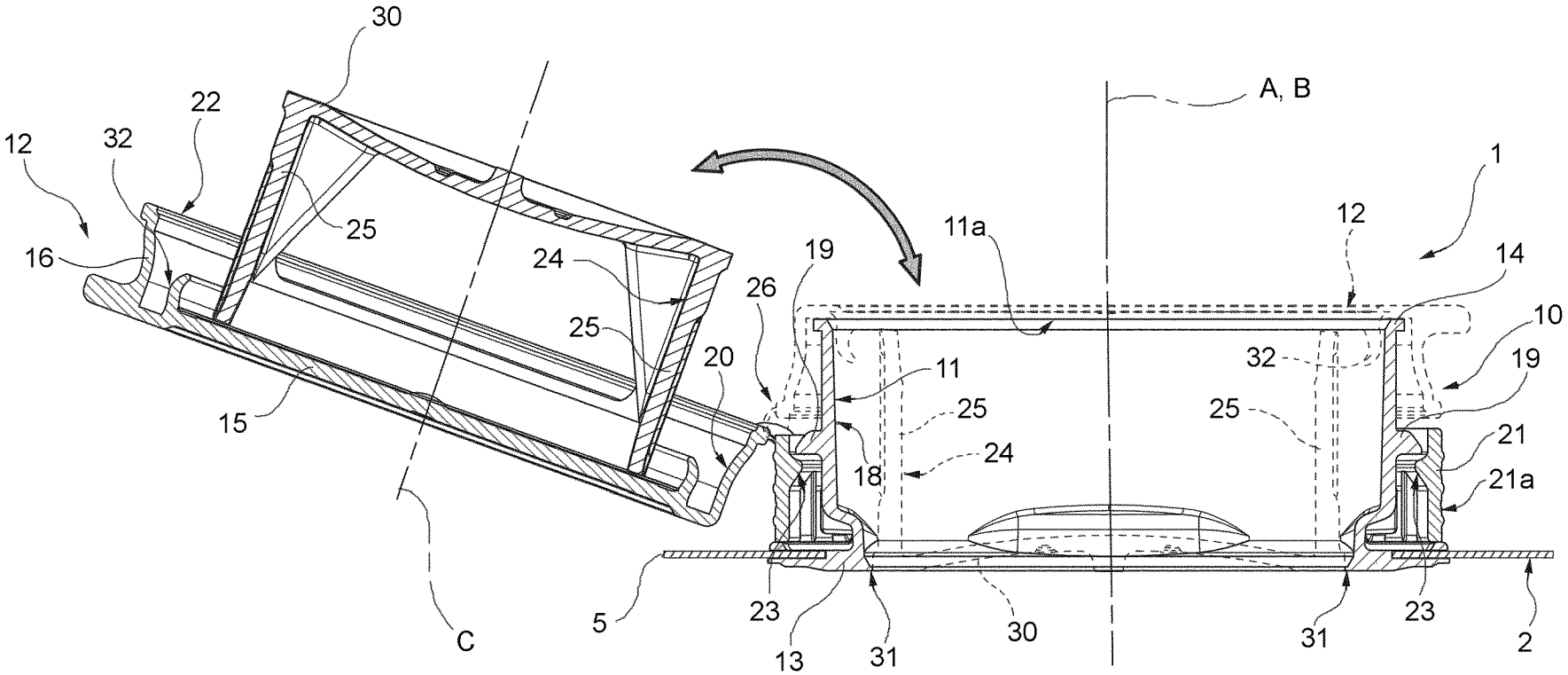
FIG. 2 is a larger-scale, partially sectioned side view of the opening device and package of FIG. 1, with parts removed for clarity.
Figure 3:
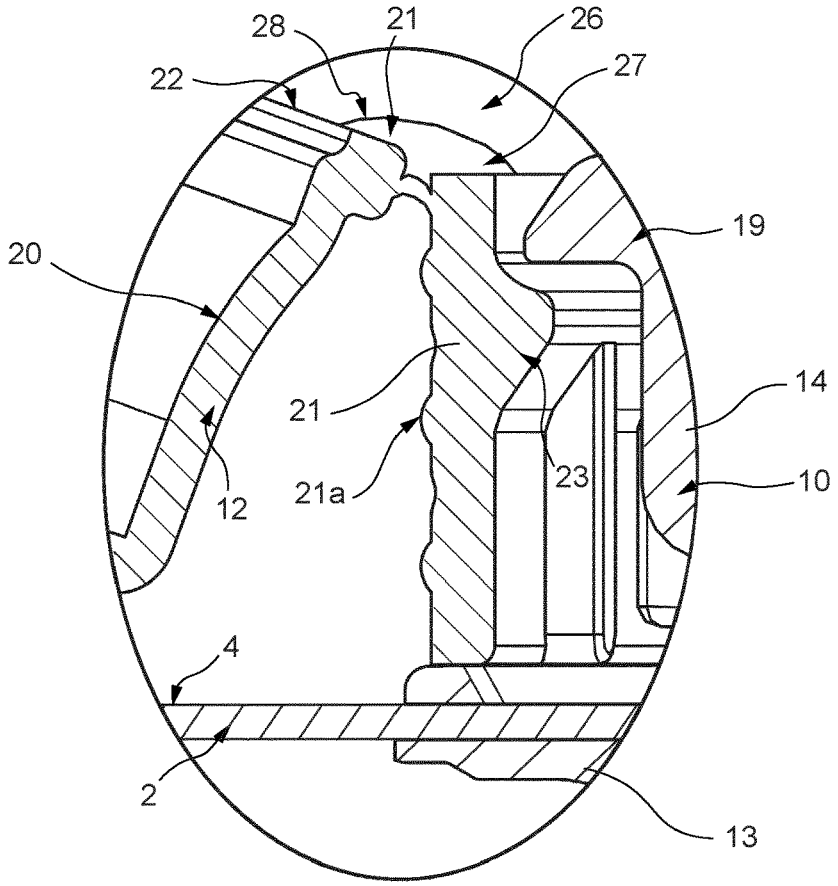
FIG. 3 is a larger-scale sectioned side view, with parts removed for clarity, of a detail of the opening device and package of FIG. 2.
Figure 4:
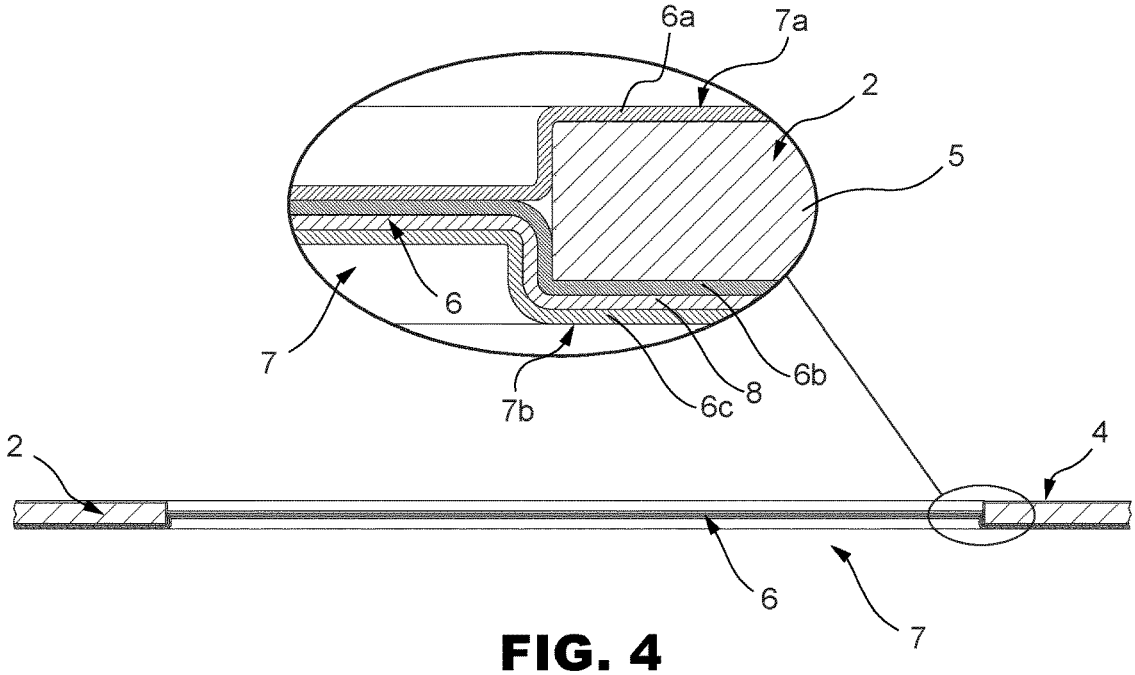
FIG. 4 is a larger-scale, partially sectioned side view of a sheet of packaging material intended to form the package of FIG. 1.

With reference to FIGS. 2 to 4, packaging material 2 comprises a base layer 5 for providing stiffness and strength, which may be made of fibrous material, e.g. paper or mineral-filled polypropylene material, and a cover layer arrangement 6.

In detail, cover layer arrangement 6 comprises a first covering layer 6*a* and a second covering layer 6*b*, both made of heat-seal plastic material, e.g. polyethylene film, and covering both sides of base layer 5.

Packaging material 2 comprises, at the opening area, a pierceable portion 7 to which opening device 1 is fitted and which is configured to be detached, at least partially, from top wall 4 in order to allow, in use and after forming of package 3, the pourable product to exit package 3.

Therefore, pierceable portion 7 defines the opening area to which opening device 1 is fitted.

In another embodiment not shown, opening area may be a through hole made in the packaging material 2, in particular in the portion of packaging material 2 forming top wall 4.

In the present case, package 3 is an aseptic package for long-storage food products; accordingly, cover layer arrangement 6 also comprises a barrier layer 8 made of gas-barrier material, e.g. aluminum foil or ethyl vinyl alcohol (EVOH) film, which is superimposed on the second covering layer 6*b* and is in turn covered with a third covering layer 6*c* of cover layer arrangement 6, made of heat-seal plastic material.

In particular, third covering layer 6*c* forms the inner face of package 3 eventually containing the pourable food product.

In other words, first covering layer 6*a*, second covering layer 6*b*, barrier layer 8 and third covering layer 6*c* define lamination layers applied, by a lamination process, to base layer 5 when producing packaging material 2 in the form of a continuous sheet, before cutting and folding it to form package 3.

Pierceable portion 7 is defined by a through hole formed only through base layer 5 and covered by first covering layer 6*a*, second covering layer 6*b*, barrier layer 8 and third covering layer 6*c*.

In practice, pierceable portion 7 is made of the above-mentioned lamination layers and closes the through hole formed in base layer 5.

Preferably, pierceable portion 7 is an integral part of cover layer arrangement 6.

According to an alternative embodiment not shown, pierceable portion 7 may be made of only one or more of first covering layer 6*a*, second covering layer 6*b*, barrier layer 8 and third covering layer 6*c*. For example, pierceable portion 7 may be made solely of barrier layer 8.

In a further alternative embodiment not shown, pierceable portion 7 may be defined by a patch attached to packaging material 2 to cover a hole formed, in this case, through the full thickness of packaging material 2.

Pierceable portion 7 has an axis A, preferably orthogonal relative to top wall 4, in particular vertical when package 3 stands on a bottom wall (not shown and substantially parallel to top wall 4).

According to the non-limiting example shown, pierceable portion 7 has a substantially circular shape concentric to axis A.

With reference to FIGS. 1 to 3, opening device 1 comprises:

a pouring spout 10 fixed to top wall 4—i.e. to packaging material 2—at pierceable portion 7 and defining a through pouring opening, i.e. a passage 11, for the pourable product ending with an opening 11*a* through which the pourable product is poured, in use;

a closing element 30 closing and/or sealing passage 11 at one region of passage 11, in particular at the same level of packaging material 2, and integrally connected to spout 10 by a smaller-section annular membrane 31 adapted to be easily torn during first opening of opening device 1; and a cap 12 configured to cooperate in contact with spout 10, in particular configured to engage spout 10 to close passage 11 at opening 11*a*, i.e. at a region of passage 11 different from (opposite to) that closed and/or sealed by closing element 30.

In detail, opening 11*a* is arranged coaxially to axis A and cap 12 is configured to engage spout 10 coaxially to axis A to close passage 11.

Annular membrane 31 defines a tear line along which to detach in use closing element 31 from spout 10.

According to this non-limiting preferred embodiment of the present invention, spout 10 and closing element are formed integrally in one piece and fitted directly onto pierceable portion 7, whilst cap 12 is formed separately from spout 10 and closing element 30 and subsequently fitted to spout 10.

In particular, according to the solution disclosed hereby, spout 10 and closing element 30 are obtained by molding molten plastic material—in particular by an injection molding operation—on the packaging material 2 before it is transformed into package 3.

More specifically, the molten plastic material is injected onto one side 7*a*—i.e. the side eventually facing the inside of package 3—of pierceable portion 7 placed in a known manner within a molding apparatus (known per se and not shown). In particular, the molten plastic material covers side 7*a* up to an annular peripheral region thereof, so as to form, in this way, closing element 30 directly attached to pierceable portion 7. The molten plastic material is then forced to pierce pierceable portion 7 at such annular peripheral region to form spout 10 projecting from an opposite side 7*b* of pierceable portion 7. More in particular, spout 10 is connected to closing element 30 through annular membrane 31.

In this way, pierceable portion 7 is first pierced and then re-sealed by the plastic material forming closing element 30.

Spout 10 comprises a base plate 13, preferably flat, molded to packaging material 2 substantially parallel to top wall 4 of package 3 so as to surround pierceable portion 7 and comprising closing element 30.

In particular, base plate 13 is molded onto side 7*a* of pierceable portion 7.

Therefore, closing element 30 and pierceable portion 7 together define a sealing portion sealing passage 11.

Closing element 30 substantially has a confetti portion and defines a substantially radial prolongation of base plate 13, transversally with respect to axis A.

In practice, closing element 30 initially closes and/or seals one axial end of passage 11, whereas cap 12 closes, in use, the opposite axial end of passage 11, i.e. opening 11*a*.

Spout 10 further comprises a cylindrical collar 14 projecting transversally, in particular orthogonally, from base plate 13, and having a longitudinal axis B coaxial, in use, to axis A. In particular, collar 14 coaxially defines passage 11. Hence, opening 11*a* is arranged coaxially also to axis B.

In practice, collar 14 of spout 10 extends through pierceable portion 7 as a follow-on from the piercing thereof, so as to be arranged on both sides 7*a*, 7*b* of pierceable portion 7.

As visible in FIGS. 1 and 2, cap 12 comprises a substantially flat circular portion 15 and a cylindrical portion 16, which projects from flat portion 15 along a longitudinal axis C of cap 12 itself and which is configured to coaxially engage collar 14 in order to close passage 11.

For this purpose, cap 12 is provided with an annular engaging portion 32 protruding from flat portion 15 in a direction substantially parallel to axis C, from the same side cylindrical portion 16 protrudes from, and configured to engage collar 14 of spout 10 in order to close passage 11.

In detail, engaging portion 32 is arranged in a position radially closer to axis C than cylindrical portion 16 and is configured to engage collar 14 defining a snap-in coupling.

In greater detail, engaging portion 32 has a substantially hook-shaped cross section, with the concave inner part facing towards axis C and the convex outer part facing an internal lateral surface 20 of cylindrical portion 16.

In use, cap 12 is moveable between:

a closed position, in which cap 12 is engaged to collar 14 thereby closing passage 11 and opening 11*a*; and an open position, in which cap 12 is disengaged from collar 14 and removed from spout 10.

When cap 12 is in the closed position, engaging portion 32 engages passage 11 of collar 14. More specifically, the outer convex part cooperates in contact with an internal surface 18 of collar 14, thereby defining the above-mentioned snap-in coupling between cap 12 and collar 14 and thereby slightly bending inwardly towards axis C (and, therefore, axis B) due to the pushing action of collar 14 thereon.

In practice, engaging portion 32 has, in its convex part, a larger diameter relatively to axis C than the diameter internal surface 18 has with respect to axis B. Therefore, when cap 12 is in its closed position, engaging portion 32 cooperates in contact with such internal surface 18 thereby undergoing a bending towards axis B and axis C and determining the interference snap-in coupling.

Opening device 1 further comprises tamper-evidence means, in particular a tamper-evidence ring 21, preferably formed integrally with cap 12, for example injection-molded together with cap 12, and initially connected coaxially to an edge 22 of cap 12 by means of a number of breakable connecting bridges.

In detail, cap 12 is engaged initially (before first opening) to collar 14 of spout 10 in the closed position, with edge 22 and tamper-evidence ring 21 still connected to one another by the breakable connecting bridges.

According to this embodiment, tamper-evidence ring 21 is substantially axially fixed relatively to axis A and axis B, and, once detached from cap 12, tamper-evidence ring 21 remains substantially axially fixed relatively to axis A and axis B.

To this end, collar 14 comprises an annular protrusion 19 defining an axial abutment for a corresponding annular protrusion 23 of tamper-evidence ring 21.

Conveniently, protrusion 19 radially protrudes outwards from collar 14 with respect to axis B, whilst protrusion 23 radially protrudes inwardly with respect to axis B, when tamper-evidence ring 21 is fitted to collar 14.

Once cap 12 is fitted onto spout 10, tamper-evidence ring 21 engages collar 14 so that protrusion 23 is arranged in an axial position closer to pierceable portion 7 than protrusion 19.

In this way, protrusion 19 acts as an upper axial stop for the respective protrusion 23, thereby preventing the axial motion of tamper-evidence ring 21 along axis A and axis B, i.e. preventing the axial removal of tamper-evidence ring 21 off collar 14.

In one embodiment, tamper-evidence ring 21 is also angularly fixed with respect to axis A and axis B.

In a further embodiment, tamper-evidence ring 21 is rotatable with respect to axis A and axis B.

Once unsealed, cap 12 is moveable between the closed position and the open position.

During first disengagement of cap 12 from collar 14, that is during first movement of cap 12 from its closed position to its open position, the connecting bridges initially connecting tamper-evidence ring 21 and cap 12 break.

More specifically, after the first disengagement of cap 12 from collar 14, protrusion 23 of tamper-evidence ring 21 axially abuts against protrusion 19, which, as stated above, acts as an axial stop for such protrusion 23.

Due to the force applied to the connecting bridges, these latter break, thereby freeing cap 12 from tamper-evidence ring 21 and permitting the disengaging of the latter from collar 14.

It is known in the field that, after unsealing cap 12, i.e. after detaching cap 12 from tamper-evidence ring 21 and disengaging cap 12 from collar 14, closing element 30 and pierceable portion 7 must also be removed in order to access the pourable product inside package 3.

For this purpose, closing element 30 comprises, in particular is formed in one piece with, a protruding portion 24 initially extending (before first opening) through passage 11 and configured to be connected, in particular welded, to cap 12, in particular to flat portion 15, once cap 12 has been fitted to spout 10.

During fitting of cap 12 to spout 10, protruding portion 24 is connected (fixed), in particular welded, to flat portion 15 according to a manner known and not described in detail.

As shown in FIG. 2, protruding portion 24 comprises two legs 25 axially protruding from closing element 30 and connecting closing element 30 with flat portion 15, once cap 12 has been fitted to spout 10.

In particular, legs 25 are formed in one piece with closing element 30 and spout 10 during injection of the molten plastic material at pierceable portion 7, as described above.

During first opening of opening device 1, cap 12 is pulled up by the user. Consequently, cap 12 is disengaged from collar 14 and legs 25, welded to flat portion 15, exert a pulling action on closing element 30. Accordingly, closing element 30 is torn from base plate 13 of spout 10 along annular membrane 31.

In particular, the tearing starts at a given point of annular membrane 31, which acts as a weakened region of base plate 13, and then propagates to the rest of membrane 31 until it causes a complete detachment of closing element 30 from spout 10, and, therefore, of pierceable portion 7 from packaging material 2 and top wall 4 (FIG. 2).

According to an important aspect of the present invention, cap 12 is hinged to tamper-evidence ring 21, thereby being permanently tethered to spout 10, once cap 12 is fitted thereto.

In detail, opening device 1 comprises a hinge element, preferably defined by a plastic hinge 26, permanently hinging cap 12 to tamper-evidence ring 21.

Hence, hinge 26 is so configured as to allow cap 12 to be disengaged from collar 14 and to prevent cap 12 from being detached (and in particular disposed of separately) from spout 10, i.e. from packaging material 2 and/or package 3.

Preferably, hinge 26 is angularly fixed relatively to axis A, in particular to axis A and to axis B, more in particular to axis A, axis B and axis C.

In detail, hinge 26 comprises a first end portion 27 fitted to cap 12, a second end portion 28 fitted to tamper-evidence ring 21 and a connection portion 29 connecting first end portion 27 and second end portion 28 to one another.

As visible in FIGS. 2 and 3, first end portion 27 is fitted to cylindrical portion 16 of cap 12, and second end portion 28 is fitted to an external lateral surface 21*a* of tamper-evidence ring 21.

More specifically, first end portion 27 is fitted to edge 22.

According to an alternative embodiment not shown, first end portion 27 is fitted to flat portion 15.

In this specific example, first end portion 27, second end portion 28 and connection portion 29 are formed integrally in one piece.

Preferably, cap 12 and hinge 26 are formed integrally in one piece.

Even more preferably, cap 12, hinge 26 and tamper-evidence ring 21 are formed integrally in one piece, and subsequently fitted to spout 10, as described above.

According to this non-limiting preferred embodiment, tamper-evidence ring 21 is also angularly fixed with respect to axis A and axis B, in a manner known and not described in detail—e.g. by means of coupling between protrusions and recesses.

Thanks to this configuration, during pouring of pourable product outside of package 3, an undesired movement of cap 12 in front of the pouring trajectory of the pourable product exiting from package 3 is prevented.

In view of the above, hinge 26 defines a region of maximum distance of cap 12 from spout 10, within which cap 12 can be moved away from and towards spout 10, and without interfering with the pourable product exiting, in use, from package 3.

The operation of opening device 1 is described hereinafter with reference to FIGS. 1 and 2 and starting from a condition in which cap 12 is still received on spout 10.

Starting from this condition, to open package 3, the user disengages cap 12, thereby causing the connecting bridges of tamper-evidence ring 21 to break and causing the tearing of closing element 30 from base plate 13, which determines the tearing of pierceable portion 7.

This action of disengagement displaces cap 12 from its closed position to its open position.

During the displacement of cap 12 from the closed position to the open position, cap 12 is tethered to spout 10 by means of hinge 26, as described above.

Once the desired amount of pourable product has been poured through passage 11, the user can close passage 11 by engaging again cap 12 to collar 14.

The advantages of opening device 1 according to the present invention will be clear from the foregoing description.

In particular, thanks to the presence of hinge 26, cap 12 is firmly tethered to spout 10 and, therefore, to packaging material 2 and/or package 3 and the risk of dispersing cap 12 in the environment after use of package 3 is consistently reduced, thereby preventing plastic pollution of the environment, whilst maintaining at least the same versatility of the opening devices known in the art and not provided with hinge 26.

In addition, as hinge 26 is formed integrally with cap 12 and tamper-evidence ring 21, its implementation only requires minor design modification to the structure of cap 12 and tamper-evidence ring 21 and there is no need for design modifications and adaptations of spout 10.

Clearly, changes may be made to opening device 1 as described herein without, however, departing from the scope of protection as defined in the accompanying claims.

The invention claimed is:

1. An opening device configured to be applied to a packaging for pourable products, said opening device comprising:

a pouring spout defining a pouring opening through which to pour, in use, said pourable product;

a cap configured to engage and disengage said pouring spout to respectively close and open said pouring opening;

a closing element closing and/or sealing said pouring opening, formed in one piece with said pouring spout and connected to said pouring spout by a breakable connecting portion configured to break during first opening of said opening device; said closing element comprising a protruding portion extending through said pouring opening and connected to said cap; and tamper-evidence means fitted to said pouring spout and initially connected to said cap by means of at least one breakable connecting bridge configured to break during first opening of said opening device;

said cap being hinged to said tamper-evidence means thereby being permanently tethered to said pouring spout.

2. The opening device as claimed in claim 1, and further comprising a hinge element permanently hinging said cap to said tamper-evidence means.

3. The opening device as claimed in claim 2, wherein said hinge element comprises a first end portion fitted to said cap, a second end portion fitted to said tamper-evidence means, and a connection portion connecting said first end portion and said second end portion to one another.

4. The opening device as claimed in claim 3, wherein said cap comprises a top portion and a lateral portion, said lateral portion projecting from said top portion and being configured to engage said pouring spout to close said pouring opening;

said first end portion being fitted to said lateral portion.

5. The opening device as claimed in claim 3, wherein said tamper-evidence means comprise a tamper-evidence ring configured to be fitted to said pouring spout;

said second end portion being fitted to an external lateral surface of said tamper-evidence ring.

6. The opening device as claimed in claim 5, wherein said pouring spout comprises a cylindrical collar having a first longitudinal axis and coaxially defining said pouring opening;

said cap having a second longitudinal axis and being configured to coaxially engage said collar to close said pouring opening;

said tamper-evidence ring being configured to be fitted coaxially around said collar and to be axially fixed relatively to said first longitudinal axis.

7. The opening device as claimed in claim 2, wherein said cap and said hinge element are formed integrally in one piece.

8. The opening device as claimed in claim 2, wherein said cap, said hinge element and said tamper-evidence means are formed integrally in one piece.

9. The opening device as claimed in claim 1, wherein said cap is configured to engage said pouring spout in a snap-in manner.

10. The opening device as claimed in claim 1, wherein said closing element is made of plastic material molded onto an opening portion of said packaging.

11. The opening device as claimed in claim 1, wherein said breakable connecting portion is configured to break by means of the pulling action exerted by said cap onto said protruding portion.

12. A package containing a pourable product and obtained from a sheet of packaging material having an opening portion;

said package comprising the opening device as claimed in claim 1, and fitted at said opening portion.

13. The package as claimed in claim 12, wherein said pouring spout of said opening device is made of plastic material molded onto said opening portion.

14. The package as claimed in claim 12, wherein said closing element of said opening device is made of plastic material molded onto said opening portion.

* * * * *